US009194562B2

(12) United States Patent
Kim

(10) Patent No.: US 9,194,562 B2
(45) Date of Patent: Nov. 24, 2015

(54) LED LAMP AND METHOD FOR MANUFACTURING THE SAME

(71) Applicant: SAMSUNG ELECTRONICS CO., LTD., Gyeonggi-do (KR)

(72) Inventor: Sung Jin Kim, Seoul (KR)

(73) Assignee: SAMSUNG ELECTRONICS CO., LTD., Suwon-Si, Gyeonggi-Do (KR)

( * ) Notice: Subject to any disclaimer, the term of this patent is extended or adjusted under 35 U.S.C. 154(b) by 323 days.

(21) Appl. No.: 13/844,676

(22) Filed: Mar. 15, 2013

(65) Prior Publication Data

US 2013/0250587 A1 Sep. 26, 2013

(30) Foreign Application Priority Data

Mar. 20, 2012 (KR) ..... 10-2012-0028174

(51) Int. Cl.

| | |
|---|---|
| ***F21V 29/00*** | (2015.01) |
| ***F21V 15/01*** | (2006.01) |
| ***F21V 21/00*** | (2006.01) |
| ***F21K 99/00*** | (2010.01) |
| ***F21V 3/02*** | (2006.01) |
| ***F21V 29/507*** | (2015.01) |
| ***F21V 29/70*** | (2015.01) |
| *F21Y 101/02* | (2006.01) |

(52) U.S. Cl.

CPC ..... *F21V 15/011* (2013.01); *F21K 9/1355* (2013.01); *F21K 9/90* (2013.01); *F21V 3/02* (2013.01); *F21V 21/00* (2013.01); *F21V 29/507* (2015.01); *F21V 29/70* (2015.01); *F21Y 2101/02* (2013.01); *Y10T 29/49124* (2015.01)

(58) Field of Classification Search

CPC ..... F21V 15/011; F21V 21/00; F21V 29/70; F21V 29/507; F21V 3/02; F21K 9/10; F21K 9/13; F21K 9/135; F21K 9/1355; F21K 9/30; F21K 9/90; Y10T 29/49124; F21Y 2101/02

See application file for complete search history.

(56) References Cited

U.S. PATENT DOCUMENTS

2011/0292651 A1* 12/2011 Kovacik et al. ..... 362/235

FOREIGN PATENT DOCUMENTS

| | | | |
|---|---|---|---|
| JP | 2010-160949 | A | 7/2010 |
| KR | 2008-0074838 | A | 8/2008 |
| KR | 2010-0111336 | A | 10/2010 |

* cited by examiner

*Primary Examiner* — Thomas M Sember

(74) *Attorney, Agent, or Firm* — McDermott Will & Emery LLP

(57) ABSTRACT

A light emitting diode (LED) lamp includes a lamp housing formed of a pair of housing members connected to each other in a horizontal direction. A printed circuit board (PCB) is detachably connected to an inside of the lamp housing, and includes at least one LED mounted to one surface of the PCB. A power supply unit (PSU) is electrically connected with the PCB in the lamp housing to supply power to the PCB.

19 Claims, 7 Drawing Sheets

LED LAMP AND METHOD FOR MANUFACTURING THE SAME

CROSS-REFERENCE TO RELATED APPLICATION

This application claims the benefit of Korean Patent Application No. 10-2012-0028174, filed on Mar. 20, 2012 in the Korean Intellectual Property Office, the disclosure of which is incorporated herein by reference in its entirety.

BACKGROUND

1. Field of the Invention

The present application relates to a light emitting diode (LED) lamp and a manufacturing method for the same, and more particularly, to an LED lamp having a reduced number of parts and accordingly having reduced material costs. The LED lamp has a cover portion and a heat radiating structure mounted integrally to a housing, and assembly of the LED lamp is facilitated by enabling the assembly of parts to be performed in a horizontal direction. The application further describes a method of manufacturing the LED lamp.

2. Description of Related Art

A light emitting diode (LED) refers to a semiconductor device that emits light as an electric current flows through the device. The LED can refer to a p-n junction diode formed of gallium arsenic (GaAs), Ga nitride (GaN), or other appropriate optical semiconductor materials, which converts electrical energy to optical energy in response to current flowing through the junction diode.

Recently, blue LEDs and ultraviolet (UV) LEDs have been introduced which incorporate nitrides having excellent physical and chemical characteristics. Since the blue LEDs or UV LEDs can be used to produce white light or other monochromatic lights using a phosphor material, the LEDs can be used in a wide range of applications.

LEDs have a relatively long lifetime, and can be made to have small sizes and low weight. Since the light emission of LEDs has good directivity, LEDs can be driven using low-amplitude voltages. In addition, LEDs are durable against impact and vibration and do not require preheating and complicated driving, making them useful for a wide variety of uses. For example, LEDs are used in applications spanning small lighting for mobile terminals, general interior and exterior lighting, vehicle lighting, backlight units (BLU) for large-area liquid crystal display (LCD), and the like.

LED lamps are used in an increasingly wide variety of applications. However, the high price of LED lamps remains an important factor in consumers' decisions to adopt LED lights and lighting systems. Therefore, a reduction in material costs of LED lamps could greatly expand the LED lamp market. However, because of structural characteristics of commonly used LED lamps, material costs of such lamps are difficult to bring down.

Commonly used LED lamps are structured in such a manner that a printed circuit board (PCB) having an LED mounted to one surface is mounted to a housing. A circuit is inserted inside the housing, while a cover portion of the housing covers the PCB and the LED. That is, a plurality of parts are vertically connected, thereby constituting the LED lamp.

However, the vertical connection structure requires a large number of parts and complicates assembly. In addition, the large number of parts need to be separately manufactured (e.g., the separate housing and cover), making it difficult to reduce the material costs of the lamps.

Accordingly, there is a need for new LED lamps having simplified structures that facilitate assembly and reduce material costs.

SUMMARY

An aspect of the present invention provides a light emitting diode (LED) lamp and a method of manufacturing the LED lamp. In one example, the LED lamp has a cover portion and a heat radiating structure integrally mounted to a housing of the LED lamp, thereby reducing a number of parts, reducing material costs, and improving the ease of assembly by enabling assembly of parts in a horizontal direction.

According to an aspect of the present invention, there is provided an LED lamp including a lamp housing including a pair of housing members connected to each other in a horizontal direction. A printed circuit board (PCB) is detachably connected to an inside of the lamp housing, and includes at least one LED mounted to one surface of the PCB. A power supply unit (PSU) electrically connected to the PCB in the lamp housing to supply power to the PCB.

Each housing member of the pair of housing members may include a cover portion. The PCB is detachably connected to a lower end of the cover portion, and when the pair of housing members are connected to each other, the cover portions of the pair of housing members enclose an inner space within which the PCB (including the at least one LED) is detachably disposed. A heat radiation portion is disposed below the cover portion and is configured to radiate heat generated from the LED. A PSU receiving portion is disposed below the heat radiation portion and is configured to receive the PSU when the PSU is detachably connected to the PSU receiving portion.

The cover portion may include an insertion groove to hold the PCB to an inside of the cover portion when an outer part of the PCB is inserted into the groove.

The heat radiation portion may be disposed in a space located between the cover portion and the PSU receiving portion, and is configured to dissipate heat generated by the at least one LED as air flows through the space.

The LED lamp may further include a connection unit configured to connect the cover portion to the PSU receiving portion such that the heat radiation portion is disposed between the cover portion and the PSU receiving portion.

The connection unit may include a wire passing portion configured to connect the cover portion to the PSU receiving portion and to include a power line passing therethrough to connect the PCB to the PSU. The connection unit may include a vent hole forming portion configured to connect the cover portion with an outer part of the PSU receiving portion and to provide a vent hole for providing airflow in a space located between the cover portion and an outside of the LED lamp.

The lamp housing may further include a housing connection member configured to fit over one end of each of the pair of housing members when the pair of housing members are connected to each other.

The housing member may include a male screw thread formed at one end, and the housing connection member may include a female screw thread formed on an inside surface, so that the pair of housing members and the housing connection member are screw-connected together by engaging the male screw thread with the female screw thread.

The cover portion may include a heat sink plate detachably connected thereto and configured to be disposed between the PCB and the heat radiation portion.

Each housing member of the pair may be integrally formed by plastic injection molding.

According to another aspect of the present invention, there is provided a method of manufacturing an LED lamp which includes a lamp housing having a pair of housing members horizontally connected to each other. The method includes mounting a PCB, to which at least one LED is mounted, to an inside of one housing member of the pair of housing members; mounting a PSU which supplies power to the PCB to the inside of the one housing member; and connecting the other housing member to the one housing member in a horizontal direction.

Each housing member of the pair of housing members may include a cover portion. The PCB can be detachably connected to a lower end of the cover portion. When the pair of housing members are connected to each other, the cover portions of the pair of housing members can enclose an inner space within which the PCB including the at least one LED is detachably connected. A heat radiation portion can be disposed below the cover portion and configured to radiate heat generated from the at least one LED. A PSU receiving portion can be disposed below the heat radiation portion and configured to receive the PSU when the PSU is detachably connected to the PSU receiving portion. The PCB can be connected to the cover portion during the mounting of the PCB to the inside of the one housing member, the PSU can be mounted to the PSU receiving portion during the mounting of the PSU to the inside of the one housing member, and the PCB and the PSU can be electrically connected together using a power line.

Each housing member may be integrally formed by plastic injection molding such that the cover portion, the heat radiation portion, and the PSU receiving portion of the housing member can form part of a unitary member.

The PCB may be horizontally inserted into the cover portion during the mounting of the PCB to the inside of the one housing member, and the PSU can be horizontally inserted into the PSU receiving portion during the mounting of the PSU to the inside of the one housing member.

The connecting the other housing member to the one housing member may include horizontally connecting the one housing member to the other housing member; and connecting a housing connection member so as to enclose one end of each of the pair of housing members being connected to each other within the housing connection member.

Additionally, a light emitting diode (LED) lamp can include a printed circuit board (PCB) having at least one LED mounted to one surface thereof; a power supply unit (PSU) electrically connected to the PCB, wherein the PSU is connected to a surface of the PCB opposite to the one surface; and a lamp housing having a rotational symmetry around an axis of rotational symmetry. The PCB and PSU can be located within the lamp housing along the axis of rotational symmetry, and the lamp housing can include first and second housing members that contact each other along a plane including the axis of rotational symmetry when the first and second housing members are assembled together to form the lamp housing.

The first and second housing members may be identical to each other, and each of the first and second housing members can include a groove for mounting the PCB therein, wherein the PCB is held in place by the grooves of the first and second housing members when the first and second housing members are assembled together. The first and second housing members can further include a cover portion formed on one side of the groove, wherein the cover portions of the first and second housing members and the one surface of the PCB define an internal volume of the housing when the first and second housing members and the PCB are assembled together. The first and second housing members can additionally include a PSU receiving portion formed on another side of the groove, wherein the PSU receiving portions of the first and second housing members are in contact with the PSU when the first and second housing members are assembled together.

A housing connection member may be configured to fit around a portion of and hold together the first and second housing members when the first and second housing members are assembled together. The housing connection member may be rotationally symmetric and disposed along the axis of rotational symmetry when holding together the first and second housing members.

Each of the first and second housing members can further include a second groove for mounting a heat sink therein, such that the heat sink is held in place by the second grooves of the first and second housing members when the first and second housing members are assembled together, and such that each second groove is located on a side of the groove that is opposite to the cover portion.

BRIEF DESCRIPTION OF THE DRAWINGS

These and/or other aspects, features, and advantages of the invention will become apparent and more readily appreciated from the following description of exemplary embodiments, taken in conjunction with the accompanying drawings in which.

DETAILED DESCRIPTION

Figure 1:
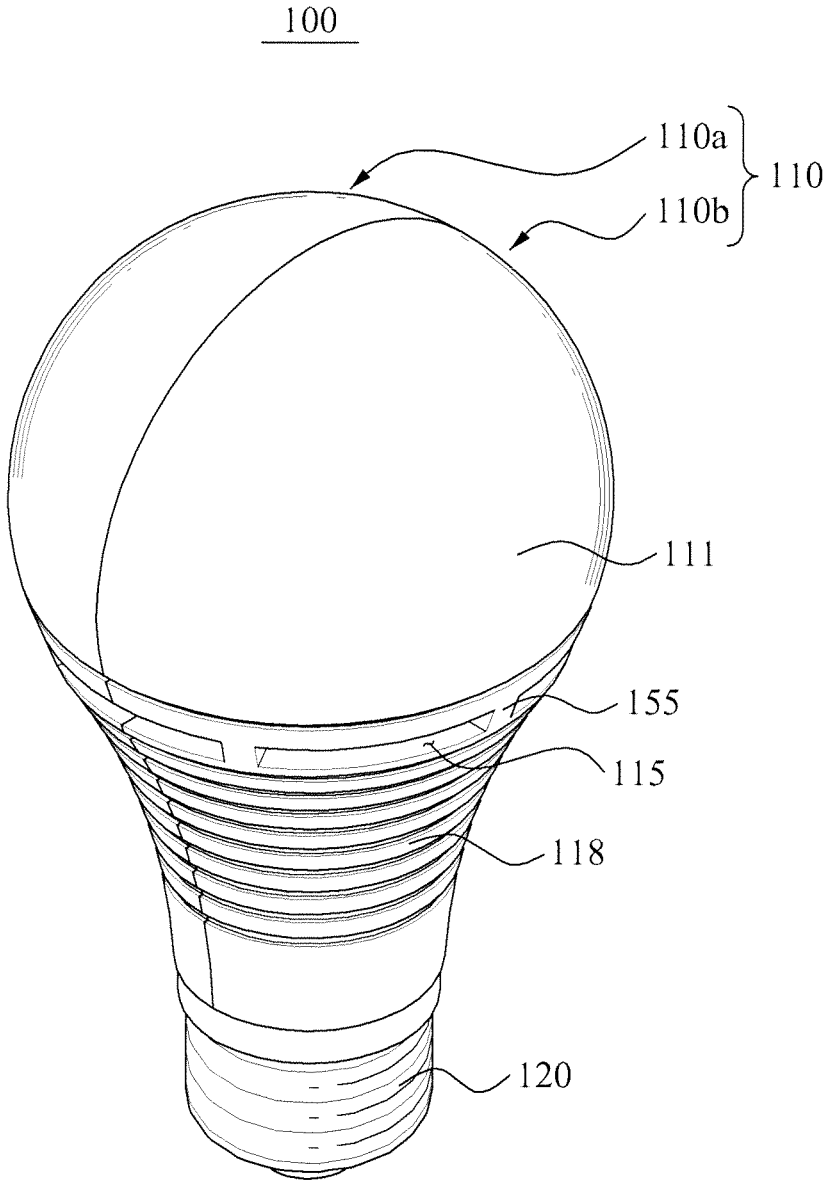
FIG. 1 is a perspective view illustrating a light emitting diode (LED) lamp according to one embodiment of the present invention.

Reference will now be made in detail to exemplary embodiments of the present invention, examples of which are illustrated in the accompanying drawings, wherein like reference numerals refer to like elements throughout.

Figure 2:
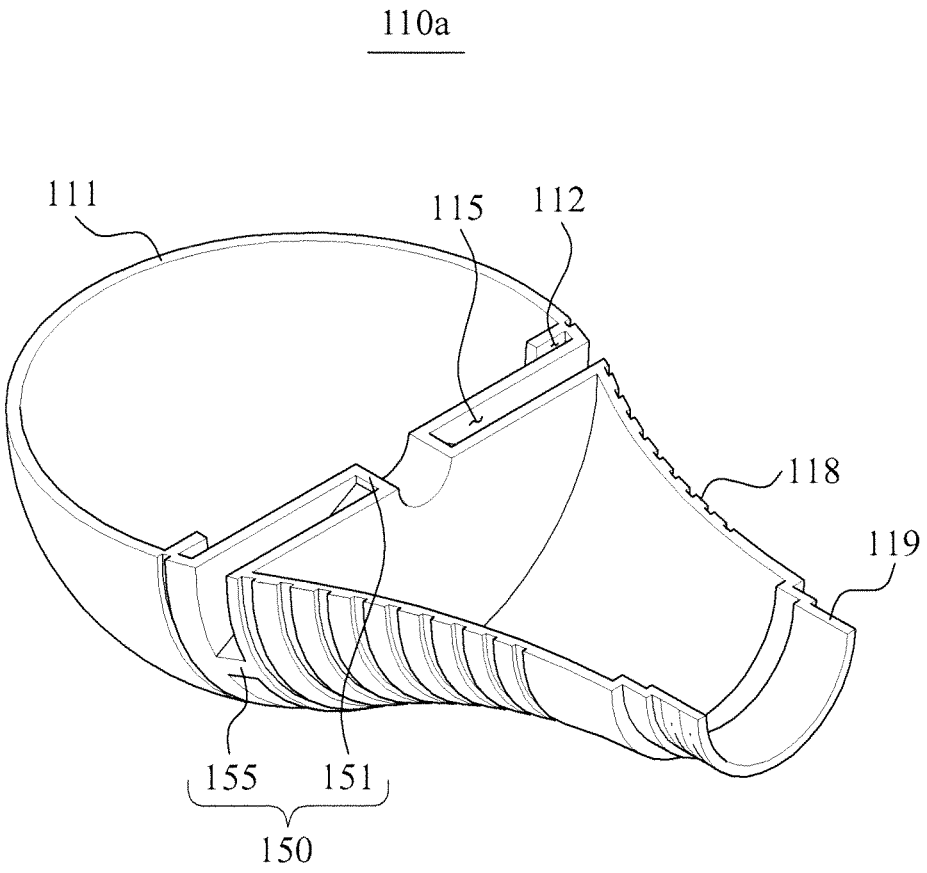
FIG. 2 is a perspective view illustrating a housing member forming part of the lamp housing shown in FIG. 1.
Figure 3:
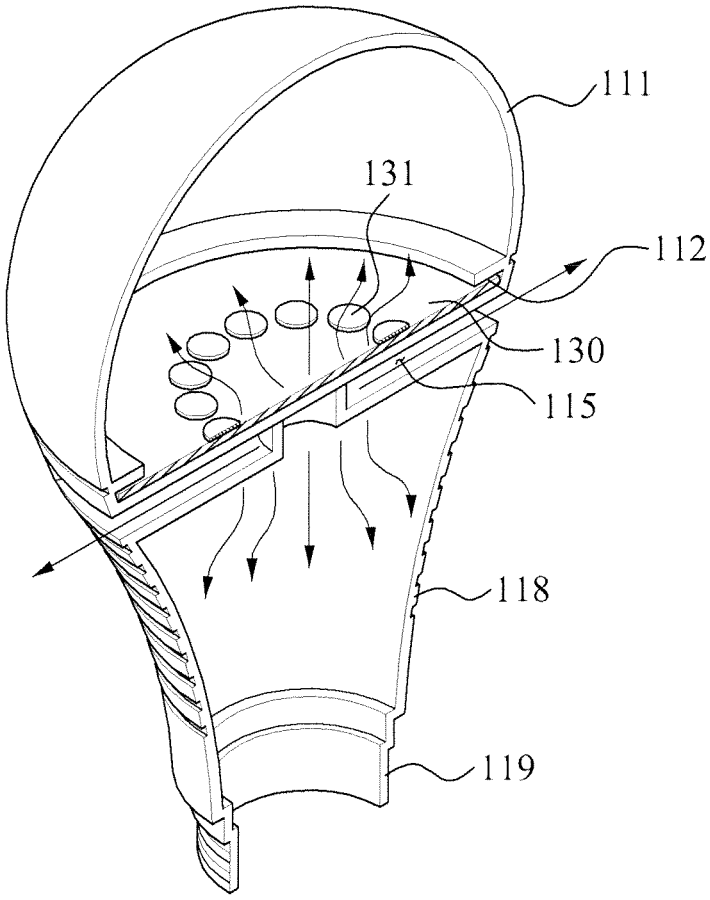
FIG. 3 is a diagram schematically illustrating heat radiating from a printed circuit board (PCB) mounted to the housing member shown in FIG. 2.
Figure 4:
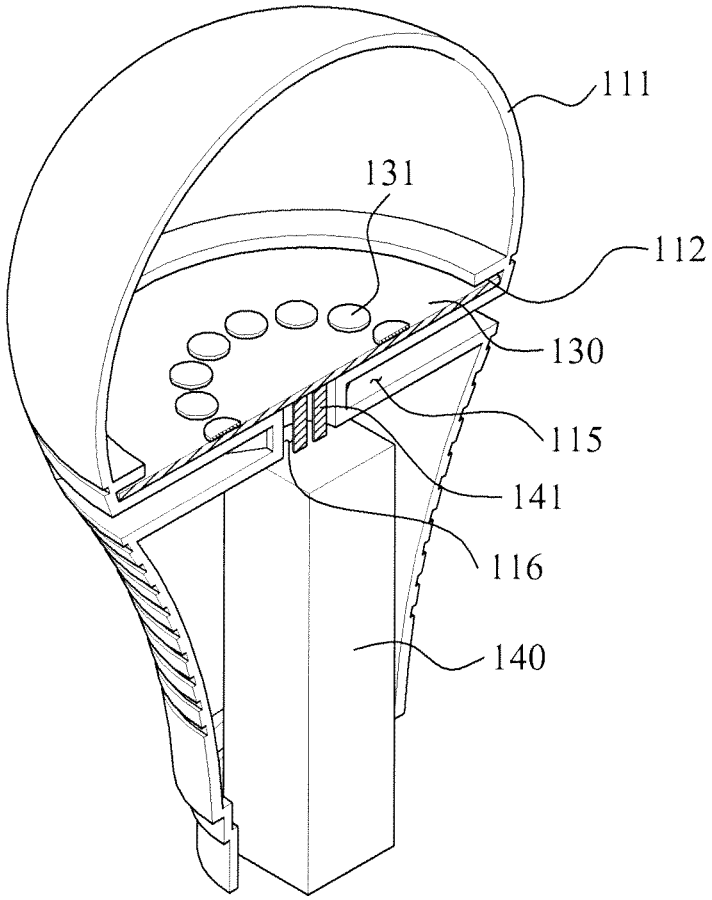
FIG. 4 is a diagram illustrating an electrical connection between the PCB mounted to the housing member of FIG. 2 and a power supply unit (PSU)

FIG. 1 is a perspective view of an illustrative light emitting diode (LED) lamp 100 according to an embodiment of the present invention. FIG. 2 is a perspective view of an illustrative housing member included in a lamp housing 110 such as the lamp housing shown in FIG. 1. FIG. 3 is a diagram illustratively showing heat radiating from a printed circuit board (PCB) 130 mounted to the housing member of FIG. 2. FIG. 4 is a diagram illustratively showing an electrical connection between the PCB mounted to the housing member and a power supply unit (PSU) 140.

As shown in FIGS. 1-4, the LED lamp 100 may include a lamp housing 110 which is shaped so as to define the external appearance of the LED lamp 100. The lamp housing 110 can be formed of two or more housing members 110*a*, 110*b* connected together through a horizontal connection. The PCB 130 is detachably connected to an inside of the lamp housing 110, and includes a plurality of LEDs 131 disposed on one surface thereof. The PSU 140 can be electrically connected to the PCB 130 inside the lamp housing 110 to supply power to the PCB 130.

As will be described in detail, the structure of the LED lamp 100 may be simplified so as to reduce material costs and facilitate the assembly of component parts of the lamp.

As shown in FIG. 1, the lamp housing 110 may include a pair of housing members 110*a* and 110*b* which are shaped to define the external appearance of the LED lamp 100. The housing members 110*a*, 110*b* can be connected to each other. A housing connection member 120 can then be connected to lower ends of the pair of housing members 110*a* and 110*b*, so as to hold the pair of housing members 110*a* and 110*b* connected to each other.

The pair of housing members 110*a* and 110*b* are connected in a horizontal direction. That is, the pair of housing members 110*a* and 110*b* are connected together by moving the housing members towards each other in a horizontal direction or plane, wherein the horizontal direction is defined as a direction perpendicular to an axis of rotational symmetry of the LED lamp 100. When assembled together, the pair of housing members 110*a* and 110*b* form an inner space or internal volume in which the PCB 130 can be mounted and in which the PSU 140 can be inserted. Because the assembly of the elements is performed along a horizontal direction or plane, the assembly may be facilitated in comparison to other LED lamps (not shown) which rely on a vertical assembly structure.

In addition, the pair of housing members 110*a* and 110*b* may each have an integrated structure in which each housing member is formed of a single, unitary member. In such examples, the LED lamp 100 can thus rely on a reduced number of parts for assembly. Additionally, the material costs may be reduced. For example, each member of the pair of housing members 110*a* and 110*b* may be manufactured by plastic injection molding to form a member such as the member shown in FIG. 2. In such an example, separate post-processing of the housing member is unnecessary (such as post-processing for assembling together multiple component parts of a housing member), notably in cases in which each housing member is formed of a single plastic injection molded part. Also, when plastic injection molding is used, the number of members that can be made using a same mold (e.g., a guaranteed number of shots per mold) may be increased by 3 times as compared to when die-casting is used. Furthermore, by applying plastic injection molding, an LED lamp with a pleasing aesthetic appearance can be obtained. However, the manufacturing methods used for forming the pair of housing members 110*a* and 110*b* is not limited to the injection molding methods described herein. Other manufacturing methods may also be used.

The pair of housing members 110*a* and 110*b* may each include a heat radiation portion for radiating heat generated from the PCB 130. In particular, the inclusion of the heat radiation portion may enable the LED lamp 100 to function without inclusion of a separate heat sink plate commonly used in other LED lamp structures. As a result, the material cost for producing the LED lamp 100 may be reduced.

A representative housing member 110*a* of the pair of housing members 110*a* and 110*b* is shown and described in relation to FIG. 2. As shown in FIG. 2, the housing member 110*a* may include a cover portion 111 (e.g., a transparent or translucent cover portion through which light produced by LEDs 131 is emitted from the lamp). The PCB 130 to which the plurality of LEDs 131 are mounted is connected at a lower end of an inner space or volume contained within the cover portion 111. The housing member 110*a* also includes a heat radiation portion 115 disposed at a lower end of (or below) the cover portion 111 and used to radiate the heat generated from the plurality of LEDs 131 away from the PCB 130, and a PSU receiving portion 118 disposed at a lower end of (or below) the heat radiation portion 115. The PSU 140 may be detachably connected in an inner space or volume of the PSU receiving portion 118.

As shown in FIGS. 2, 3, and 4, the cover portion 111 may have a substantially hemispherical shape and include an insertion groove 112, formed on an inner wall of a lower end of the hemisphere, and configured to receive an outer circumference of the PCB 130. Accordingly, the PCB 130 may be horizontally inserted into the insertion groove 112 of the cover portion 111. Thus, a convenient connection of the PCB 130 to the housing member 110*a* may be achieved.

The PSU receiving portion 118 forms a space in which the PSU 140, and any associated circuitry, is detachably connected. The PSU receiving portion 118 may be sized or shaped to correspond to a size or shape of the PSU 140, such that the PSU 140 can be inserted into and connected to an inside of the PSU receiving portion 118 and stably maintained in the connected state.

The heat radiation portion 115 may be disposed between the cover portion 111 and the PSU receiving portion 118, and operative to radiate heat generated by the plurality of LEDs 131 to the outside, as shown by the arrows emanating out of grooves of the heat radiation portion 115 in FIG. 3.

Since the heat radiation portion 115 is disposed in a space between the cover portion 111 and the PSU receiving portion 118, the heat being radiated through a bottom of the cover portion 111 may be discharged to the outside directly through the heat radiation portion 115 along arrows shown in FIG. 3, rather than being transferred to the PSU receiving portion 118 and the PSU 140 disposed in the PSU receiving portion 118.

In addition, the heat radiation portion 115 is designed to provide airflow for cooling the PCT 130 and LEDs 131. As such, the PCB 130 and the plurality of LEDs 131 mounted to the PCB 130 may be cooled by the flow of air having a relatively low temperature.

Thus, according to one embodiment, the housing member 110*a* includes the heat radiation portion 115, which allows passage of airflow between the cover portion 111 and the PSU receiving portion 118, instead of including a separate heat sink plate for heat radiation. Therefore, the heat generated from the PCB 130 (including the plurality of LEDs 131) may be efficiently absorbed by the heat radiation portion 115 and transferred outside of the LED lamp structure. Since a separate heat sink or other heat dissipating structure is unnecessary in this case, the material costs may be reduced.

As shown in FIGS. 2, 3, and 4, the housing member 110*a* may further include a connection unit 150 for interconnecting the cover portion 111 and the PSU receiving portion 118 with the heat radiation portion 115 disposed therebetween.

The connection unit 150 may include a wire passing portion 151 connecting the cover portion 111 with a center of the PSU receiving portion 118. The wire passing portion 151 can include a through hole or other opening for passing a power line 141 to connect the PCB 130 with the PSU 140, and a vent hole forming portion 155 for connecting the cover portion 111 with an outer part of the PSU receiving portion 118. As shown, the vent hole forming portion 155 can provide a vent hole for providing airflow in a space between the cover portion 111 and the outside.

The power line 141 may be disposed within, and pass through, the wire passing portion 151, such that one end of the power line 141 is connected to a lower end of the PCB 130 while an opposite end of the power line 141 is connected to the PSU 140. The power line 141 and the outside may be isolated from each other by the wire passing portion 151. Accordingly, the wire passing portion 151 may provide electrical isolation of the power line 141 from the outside of the LED lamp structure, notably in cases in which the circuitry is not otherwise isolated.

As shown in FIG. 1, a plurality of vent hole forming portions 155 may be formed along outer parts of the cover portion 111 and the PSU receiving portion 118. The plurality of vent hole forming portions 155 may stably connect the cover portion 111 and the PSU receiving portion 118 to each other, with the heat radiation portion 115 interposed therebetween. Heat can be radiated away and cool air may be introduced through a space defined by the plurality of vent hole forming portions 155. Therefore, the heat generated by the plurality of LEDs 131 may be efficiently dissipated and the PCB and LEDs may thus be cooled.

As shown in FIG. 1, the housing connection member 120 may be connected at one end (e.g., a lower end) of the pair of housing members 110*a* and 110*b*. In one example, the housing connection member 120 is connected at an end of members 110*a* and 110*b* in which the PCB 130 (including the plurality of LEDs 131) and the PSU 140 are mounted, and the housing connection member 120 is used to stably maintain the pair of housing members 110*a* and 110*b* in their connected configuration. For the purpose of stably maintaining the members connected, a male screw thread may be formed on an outer surface of one end of the pair of housing members 110*a* and 110*b*, while a female screw thread is formed inside (or on an inside surface of) the housing connection member 120 so as to be engaged with the male screw thread when the parts are assembled. Therefore, the housing connection member 120 may be easily connected to or separated from the pair of housing members 110*a* and 110*b*.

However, the structure and the connection system of the pair of housing members 110*a* and 110*b* and the housing connection member 120 are not limited to the aforementioned description. Other shapes and connection structures may be used. In addition, a housing member (not shown) may be manufactured to include a socket portion shaped similarly to the housing connection member 120, for example. In such an example, a housing connection member may or may not be separately provided.

Thus, the LED lamp 100 according to one illustrative embodiment of the present invention is configured such that the lamp housing 110 is integrally formed with the cover portion 111 and the heat radiating structure. Therefore, a number of parts may be reduced compared to comparable LED lamp structures and also the material costs may be reduced. Additionally, since the various parts of the LED lamp 100 are designed to be connected together along a horizontal direction, the ease of assembly of the lamp is improved.

Hereinafter, an illustrative method for manufacturing the LED lamp 100 according to an embodiment of the present invention is described with reference to FIGS. 5 and 6.

Figure 5:
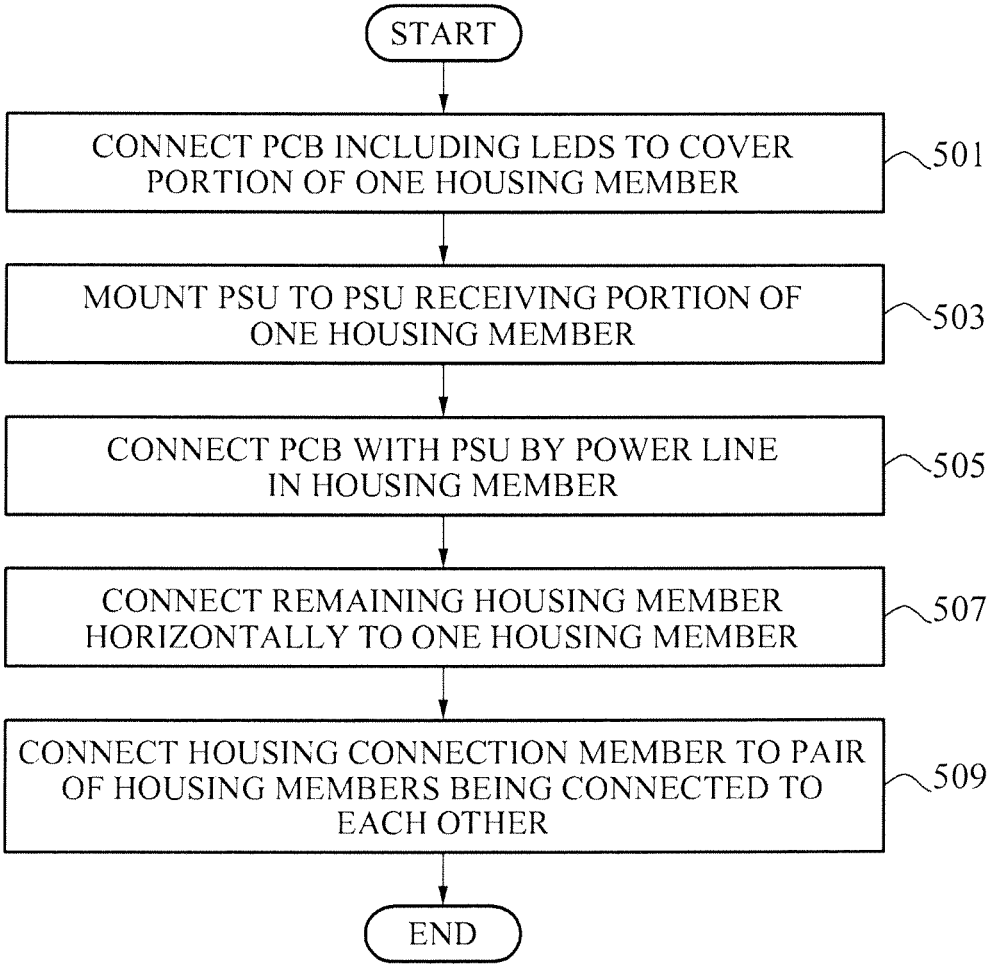
FIG. 5 is a flowchart illustrating a method of manufacturing an LED lamp according to an embodiment of the present invention.

FIG. 5 is a flowchart illustrating a method of manufacturing an LED lamp according to one embodiment of the present invention. FIG. 6 is a diagram illustrating sequential processes forming part of the manufacturing method of FIG. 5.

As shown in FIG. 5, the method for manufacturing the LED lamp 100 may include a step 501 for mounting or connecting the PCB 130, on which the plurality of LEDs 131 are mounted, to the cover portion 111 of one housing member 110*a*. In a second step 503, the PSU 140 is mounted or connected to the PSU receiving portion 118 of the one housing member 100*a*. Next, in step 505, the PCB 130 is connected or mounted to the PSU 140 using the power line 141 placed within the housing member 110*a*. In step 507, the other housing member 110*b* is connected to the one housing member 110*a* by assembling the housing members together in a horizontal direction. Finally, in step 509, the housing connection member 120 is mounted or connected to the pair of housing members 110*a* and 110*b* once they are connected with each other.

Figure 6:
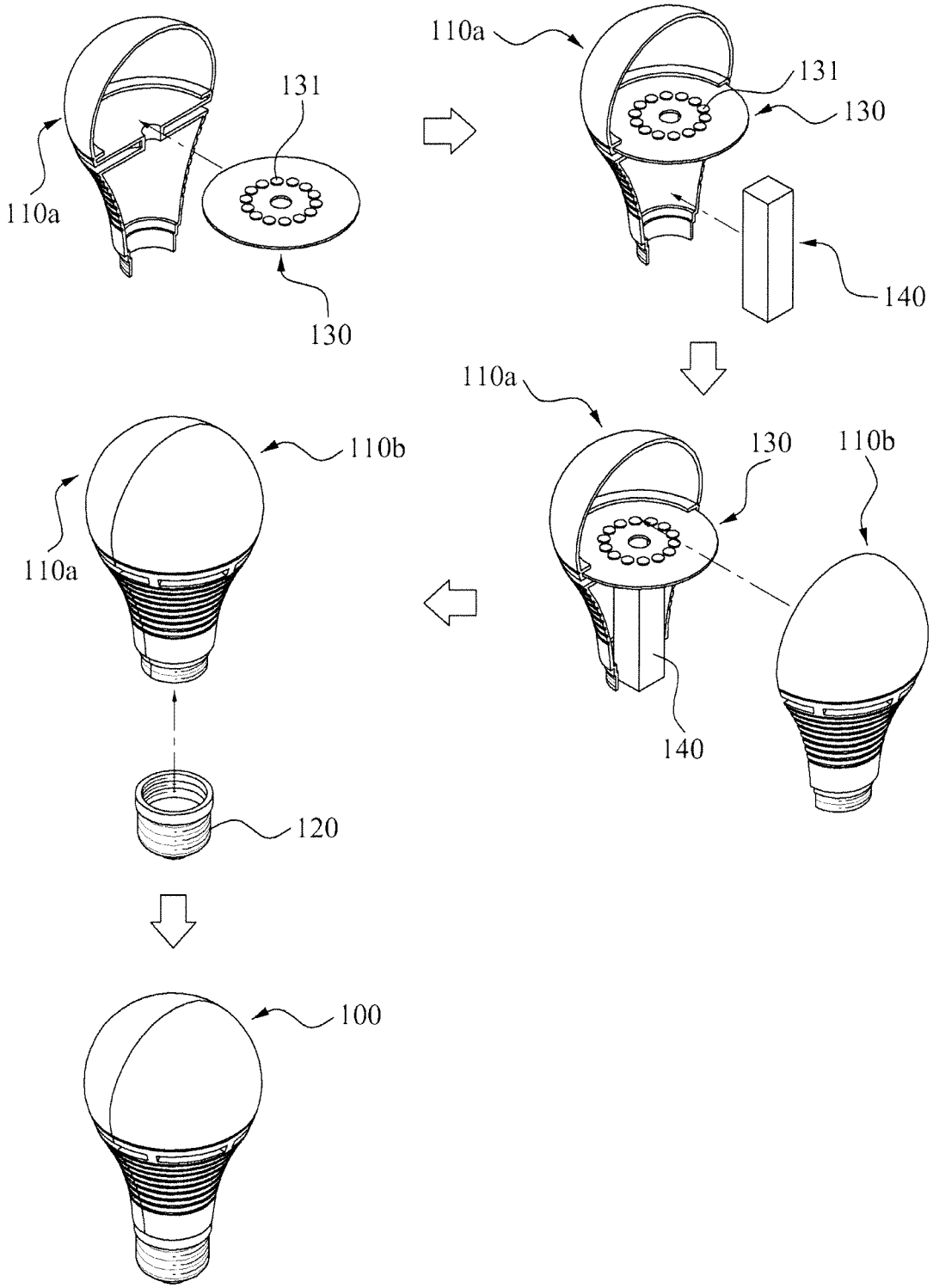
FIG. 6 is a diagram illustrating steps of the manufacturing method of FIG. 5.

First, step 501 may result in the PCB 130, on which the plurality of LEDs 131 are mounted, being mounted in the insertion groove 112 of the one housing member 110*a*, as shown in the top-left quadrant of FIG. 6. According to the present embodiment, the connecting of the PCB 130 to the housing member 110*a* may be completed by inserting the PCB 130 in the insertion groove 112 in a horizontal direction (shown as the direction of the arrow in the top-left quadrant of FIG. 6).

Step 503 may be also easily performed by horizontally mounting the PSU 140 in the PSU receiving portion 118 of the one housing member 110*a*, as shown in the top-right quadrant of FIG. 6.

After the PSU has been connected, step 505 may be performed in which the PCB 130 and the PSU 140 are electrically connected to each other using the power line 141 place within the wire passing portion 151.

When the mounting of components with respect to the one housing member 110*a* is completed, step 507 results in the other housing member 110*b* being connected to the one housing member 110*a* (as shown in the middle-right quadrant of FIG. 6. Here, a bonding connection, a hook connection, a screw connection, or the like may be applied for connecting the pair of housing members 110*a* and 110*b* together. However, the connection method is not limited to the aforementioned examples.

Finally, step 509 screw-connects the housing connection member 120 to the housing members 110*a* and 110*b*, as shown in the middle-left quadrant of FIG. 6, thereby completing manufacturing of the LED lamp 100 as shown in bottom-most quadrant of FIG. 6.

As aforementioned, since the present embodiment is configured such that the other housing member 110*b* is horizontally connected to the one housing member 110*a*, the ease of assembly of the LED lamp 100 may be improved. In addition, since the PCB 130 and the PSU 140 are easily connected in the pair of housing members 110*a* and 110*b*, the structure may be simplified.

Figure 7:
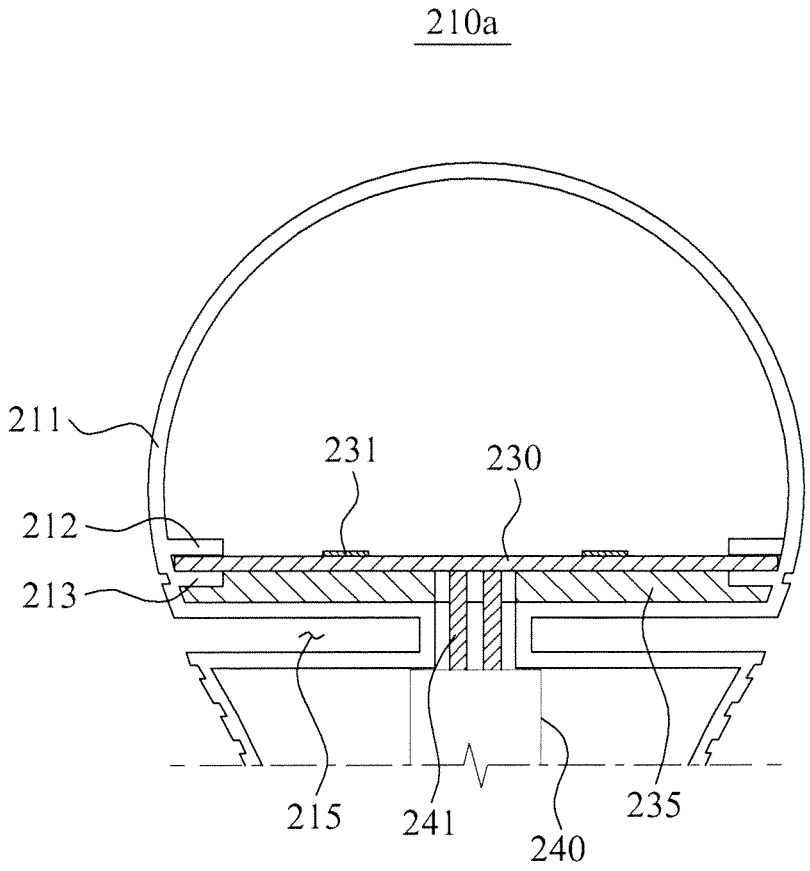
FIG. 7 is a diagram illustrating an inner structure of an LED lamp according to another embodiment of the present invention.

FIG. 7 is a diagram illustrating an inner structure of an LED lamp according to the present invention. The features of the LED lamp shown in and described in relation to FIG. 7 may be implemented in the LED lamp 100 of FIGS. 1-6, and/or in other LED lamps.

As shown in the drawing, a housing member 210*a* of the LED lamp may be integrally formed in the same manner as the housing member 110*a* of FIG. 2. A PCB 230 on which one or more LEDs 231 are mounted and a PSU 240 may be built in the housing member 210*a*, or assembled together as shown in FIG. 7 (and as described in relation to FIGS. 1-6). However, differently from the housing member 110*a* which radiates the heat generated from the LEDs 131 through the heat radiation portion 115, the housing member 210*a* may include not only a heat radiation portion 215 (similar to heat radiation portion 115 described above) but also a separate heat sink plate 235 detachably connected within an auxiliary insertion recess 213 formed in a lower portion of cover portion 211. Therefore, the heat radiation efficiency may be increased through the use of the separate heat sink plate 235.

That is, the heat generated from the LED 231 may be absorbed by the heat sink plate 235 and, additionally, radiated through the heat radiation portion 215. Therefore, the PCB 230 may be cooled quickly and efficiently.

However, as described above in relation to FIGS. 1-6, the heat sink plate 235 may be omitted so as to provide a simpler structure. For example, the PCB 230 inserted in the insertion groove 212 in FIG. 7 may instead be inserted into the auxiliary insertion groove 213 in situations in which the heat sink plate 235 is not used. Hence, the heat sink plate 235 can optionally be used, or not used.

Thus, similarly to the LED lamp structure described in relation to FIGS. 1-6, the illustrative lamp structure shown in FIG. 7 may provide a simplified structure and reduced material costs by employing a housing member 210*a* of the integrated type. Furthermore, the heat radiation efficiency may be increased through the use of the heat sink plate 235.

The above description has used directional terms (horizontal/vertical; above/below; upper/lower; etc.) to describe the relative positions of various elements as shown in the figures. It should be understood, however, that while such terms are used to describe the relative positions of elements with respect to each other, the terms do not necessarily reflect the absolute position of elements in space. For example, elements that are described as being above or below one another may be, in situations in which the LED lamp structure of FIG. 1 is turned on its side, beside each other.

Although a few exemplary embodiments of the present invention have been shown and described, the present invention is not limited to the described exemplary embodiments. Changes may be made to these exemplary embodiments without departing from the principles and spirit of the invention, the scope of which is defined by the claims and their equivalents.

What is claimed is:

1. A light emitting diode (LED) lamp comprising:

a lamp housing including a pair of housing members connected to each other in a horizontal direction;

a printed circuit board (PCB) detachably connected to an inside of the lamp housing and partitioning horizontally an inner space of the lamp housing into an upper space and a lower space, the PCB including at least one LED mounted to one surface of the PCB; and a power supply unit (PSU) electrically connected to the PCB in the lamp housing to supply power to the PCB, wherein the at least one LED emits light upwards from the one surface of the PCB board in the upper space, and the PSU is disposed in the lower space partitioned by the PCB.

2. The LED lamp of claim 1, wherein each housing member of the pair of housing members comprises:

a cover portion, wherein the PCB is detachably connected to a lower end of the cover portion, and wherein when the pair of housing members are connected to each other, the cover portions of the pair of housing members enclose an inner space within which the PCB including the at least one LED is detachably disposed;

a heat radiation portion disposed below the cover portion and configured to radiate heat generated from the at least one LED; and a PSU receiving portion disposed below the heat radiation portion and configured to receive the PSU when the PSU is detachably connected to the PSU receiving portion.

3. The LED lamp of claim 2, wherein the cover portion comprises an insertion groove to hold the PCB to an inside of the cover portion when an outer circumference of the PCB is inserted into the groove.

4. The LED lamp of claim 2, wherein the heat radiation portion is disposed in a space located between the cover portion and the PSU receiving portion, and is configured to dissipate heat generated by the at least one LED as air flows through the space.

5. The LED lamp of claim 2, further comprising a connection unit configured to connect the cover portion to the PSU receiving portion such that the heat radiation portion is disposed between the cover portion and the PSU receiving portion.

6. The LED lamp of claim 5, wherein the connection unit comprises:

a wire passing portion configured to connect the cover portion to the PSU receiving portion and to include a power line passing therethrough to connect the PCB to the PSU; and a vent hole forming portion configured to connect the cover portion with an outer part of the PSU receiving portion and to provide a vent hole for providing airflow in a space located between the cover portion and an outside of the LED lamp.

7. The LED lamp of claim 1, wherein the lamp housing further comprises a housing connection member configured to fit over one end of each of the pair of housing members when the pair of housing members are connected to each other.

8. The LED lamp of claim 7, wherein the housing member comprises a male screw thread formed on one end, the housing connection member comprises a female screw thread formed on an inside surface, and the pair of housing members and the housing connection member are screw-connected together by engaging the male screw thread with the female screw thread.

9. The LED lamp of claim 2, wherein the cover portion comprises a heat sink plate detachably connected thereto and configured to be disposed between the PCB and the heat radiation portion.

10. The LED lamp of claim 1, wherein each housing member of the pair of housing members is integrally formed by plastic injection molding.

11. A method of manufacturing a light emitting diode (LED) lamp which includes a lamp housing having a pair of housing members horizontally connected to each other, the method comprising:

mounting a printed circuit board (PCB), to one surface of which at least one LED is mounted, to an inside of one housing member of the pair of housing members to partition horizontally an inner space of the lamp housing into an upper space and a lower space;

mounting a power supply unit (PSU), which supplies power to the PCB, to the inside of the one housing member; and connecting the other housing member to the one housing member in a horizontal direction, wherein the at least one LED emits light upwards from the one surface of the PCB board in the upper space, and the PSU is disposed in the lower space partitioned by the PCB.

12. The method of claim 11, wherein each housing member of the pair of housing members comprises:

a cover portion, wherein the PCB is detachably connected to a lower end of the cover portion, and wherein when the pair of housing members are connected to each other, the cover portions of the pair of housing members enclose an inner space within which the PCB including the at least one LED is detachably disposed;

a heat radiation portion disposed below the cover portion and configured to radiate heat generated from the at least one LED; and a PSU receiving portion disposed below the heat radiation portion and configured to receive the PSU when the PSU is detachably connected to the PSU receiving portion, and wherein the PCB is connected to the cover portion during the mounting of the PCB to the inside of the one housing member, the PSU is mounted to the PSU receiving portion during the mounting of the PSU to the inside of the one housing member, and the PCB and the PSU are electrically connected together using a power line.

13. The method of claim 12, wherein each housing member is integrally formed by plastic injection molding such that the cover portion, the heat radiation portion, and the PSU receiving portion of the housing member form part of a unitary member.

14. The method of claim 12, wherein the PCB is horizontally inserted into the cover portion during the mounting of the PCB to the inside of the one housing member, and the PSU is horizontally inserted into the PSU receiving portion during the mounting of the PSU to the inside of the one housing member.

15. The method of claim 11, wherein the connecting the other housing member to the one housing member comprises:

horizontally connecting the one housing member to the other housing member; and connecting a housing connection member so as to enclose one end of each of the pair of housing members being connected to each other within the housing connection member.

16. A light emitting diode (LED) lamp comprising:

a printed circuit board (PCB) having at least one LED mounted to one surface thereof and partitioning horizontally an inner space of the lamp housing into an upper space and a lower space;

a power supply unit (PSU) electrically connected to the PCB, wherein the PSU is connected to a surface of the PCB opposite to the one surface; and a lamp housing having a rotational symmetry around an axis of rotational symmetry, wherein the PCB and PSU are located within the lamp housing along the axis of rotational symmetry, and wherein the lamp housing includes first and second housing members that contact each other along a plane including the axis of rotational symmetry when the first and second housing members are assembled together to form the lamp housing, wherein the at least one LED emits light upwards from the one surface of the PCB board in the upper space, and the PSU is disposed in the lower space partitioned by the PCB.

17. The LED lamp of claim 16, wherein the first and second housing members are identical to each other, and wherein each of the first and second housing members include:

a groove for mounting the PCB therein, wherein the PCB is held in place by the grooves of the first and second housing members when the first and second housing members are assembled together;

a cover portion formed on one side of the groove, wherein the cover portions of the first and second housing members and the one surface of the PCB define an internal volume of the housing when the first and second housing members and the PCB are assembled together; and a PSU receiving portion formed on another side of the groove, wherein the PSU receiving portions of the first and second housing members are in contact with the PSU when the first and second housing members are assembled together.

18. The LED lamp of claim 17, further comprising:

a housing connection member is configured to fit around a portion of and hold together the first and second housing members when the first and second housing members are assembled together, wherein the housing connection member is rotationally symmetric and disposed along the axis of rotational symmetry when holding together the first and second housing members.

19. The LED lamp of claim 17, wherein:

each of the first and second housing members include a second groove for mounting a heat sink therein, the heat sink is held in place by the second grooves of the first and second housing members when the first and second housing members are assembled together, and each second groove is located on a side of the groove that is opposite to the cover portion.

* * * * *